US006726809B2

(12) United States Patent
Joyce et al.

(10) Patent No.: US 6,726,809 B2
(45) Date of Patent: Apr. 27, 2004

(54) INDUSTRIAL PROCESS FABRIC

(75) Inventors: Michael J. Joyce, Simpsonville, SC (US); Maryann C. Kenney, Foxboro, MA (US)

(73) Assignee: Albany International Corp., Albany, NY (US)

( * ) Notice: Subject to any disclaimer, the term of this patent is extended or adjusted under 35 U.S.C. 154(b) by 282 days.

(21) Appl. No.: 09/965,598

(22) Filed: Sep. 26, 2001

(65) Prior Publication Data

US 2003/0060109 A1 Mar. 27, 2003

(51) Int. Cl.[7] ..... D21F 7/08; D21F 7/12; D21F 1/10

(52) U.S. Cl. ..... 162/358.1; 162/348; 162/900; 162/902; 162/903; 428/167; 428/346; 28/110; 442/218; 442/220; 442/270; 442/271; 442/275; 442/286

(58) Field of Search ..... 100/37, 118, 120, 100/122, 151; 139/383 A, 425 A; 162/116, 117, 199, 205, 232, 306, 348, 358.1, 358.2, 358.5, 359.1, 700–704; 210/400, 401; 28/110; 442/181, 218–220, 239, 240, 270–275, 286; 428/131, 163, 166–169, 343, 346

(56) References Cited

U.S. PATENT DOCUMENTS

| | | | | | |
|---|---|---|---|---|---|
| 3,301,746 | A | | 1/1967 | Sanford et al. | |
| 3,323,226 | A | * | 6/1967 | Beaumont et al. | 34/95 |
| 3,399,111 | A | * | 8/1968 | Beaumont | 162/199 |
| 4,206,258 | A | * | 6/1980 | Balcar | 428/131 |
| 4,514,345 | A | | 4/1985 | Johnson et al. | |
| 4,526,652 | A | | 7/1985 | Waters | |
| 4,528,239 | A | | 7/1985 | Trokhan | |
| 4,529,480 | A | | 7/1985 | Trokhan | |
| 4,541,895 | A | | 9/1985 | Albert | |
| 4,637,859 | A | | 1/1987 | Trikhan | |
| 4,740,409 | A | * | 4/1988 | Lefkowitz | 428/131 |
| 4,842,905 | A | * | 6/1989 | Stech | 428/33 |
| 5,066,532 | A | | 11/1991 | Gaisser | |
| 5,126,015 | A | | 6/1992 | Pounder | |
| 5,234,551 | A | | 8/1993 | Dutt et al. | |
| 5,238,537 | A | | 8/1993 | Dutt | |
| 5,766,416 | A | | 6/1998 | Hiyoshi et al. | |
| 6,140,260 | A | * | 10/2000 | Johnson et al. | 442/270 |
| 6,159,880 | A | * | 12/2000 | Schiel | 442/270 |
| 6,183,601 | B1 | * | 2/2001 | Otto et al. | 162/205 |
| 6,350,467 | B1 | | 2/2002 | Demopoulos et al. | |
| 6,350,468 | B1 | | 2/2002 | Sanso | |
| 6,350,884 | B1 | | 2/2002 | Jones et al. | |
| 6,554,963 | B1 | * | 4/2003 | Botelho et al. | 162/289 |

FOREIGN PATENT DOCUMENTS

| | | |
|---|---|---|
| EP | 1 069 235 A1 | 7/1999 |
| EP | 0 999 306 A2 | 10/1999 |
| WO | WO 98/27277 | 6/1998 |
| WO | WO 99/09247 | 2/1999 |

* cited by examiner

*Primary Examiner*—Peter Chin
*Assistant Examiner*—Eric Hug
(74) *Attorney, Agent, or Firm*—Frommer Lawrence & Haug LLP; Ronald R. Santucci

(57) ABSTRACT

An industrial process fabrics having embossed surfaces to facilitate water removal from the product such as paper and paper products being carried thereon by creating voids through embossing to assist in fluid management.

37 Claims, 3 Drawing Sheets

INDUSTRIAL PROCESS FABRIC

FIELD OF THE INVENTION

The present invention is directed toward endless fabrics, and more particularly, fabrics used as industrial process fabrics in the production of, among other things, wet laid products such as paper, paper board, and sanitary tissue and towel products; in the production of wet laid and dry laid pulp; in processes related to papermaking such as those using sludge filters and chemiwashers; in the production of tissue and towel products made by through-air drying processes; and in the production of nonwovens produced by hydroentangling (wet process), meltblowing, spunbonding, and air laid needle punching. Such industrial process fabrics include, but are not limited to nonwoven felts; embossing, conveying, and support fabrics used in processes for producing nonwovens; filtration fabrics and filtration cloths. The term "industrial process fabrics" also includes but is not limited to all other paper machine fabrics (forming, pressing and dryer fabrics) for transporting the pulp slurry through all stages of the papermaking process. Specifically, the present invention is related to fabrics of the variety that improve fluid management by having voids on the backside thereof and/or internal void patterns embossed onto the fabric.

BACKGROUND OF THE INVENTION

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric. Typically, the newly formed cellulosic fibrous web proceeds from the forming section to a press section, which includes a series of press nips. The cellulosic fibrous web passes through the press nips supported by a press fabric, or, as is often the case, between two press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

In some applications, the conventional press nip has been replaced by long nip presses (LNP's) The LNP consists of a roll, the belt, and a pressure shoe, which faces toward the roll and applies pressure to the fibrous webs and web-transporting papermaker's press fabric or fabrics in the nip. Due to their dimensions, LNP's offer a greater pressing area than what is available with a conventional press nip formed by two press rolls. The belts that run on LNP's are known as shoe press belts. The belts are coated on at least one side with a resin rendering the belt impermeable to oil, water and air, and they may be coated on both sides. Examples of these kinds of belts are known in the art. U.S. Pat. Nos. 5,234,551 and 5,238,537 disclose shoe press belts on an LNP.

The paper sheet finally proceeds to a dryer section, which may include at least one series of rotatable dryer drums or cylinders, which are internally heated by steam. The newly formed paper sheet is directed in a serpentine path sequentially around each of the drums by a dryer fabric, which holds the paper sheet closely against the surfaces of the drums. The heated drums reduce the water content of the paper sheet to a desirable level through evaporation.

It should be appreciated that forming, pressing, and dryer fabrics all take the form of endless loops on the paper machine and function in the manner of conveyors. It should further be appreciated that paper manufacture is a continuous process which proceeds at considerable speed. That is to say, the fibrous slurry is continuously deposited onto the forming fabric in the forming section, while a newly manufactured paper sheet is continuously wound onto rolls after it exits from the dryer section.

In the production of some paper products, such as paper towels, facial tissues and paper napkins, through-air-drying for example augments or replaces the press dewatering described above. In through-air drying, the newly formed cellulosic fibrous web is transferred from the forming fabric directly to an air-pervious through-air-drying (TAD) fabric. Heated air is directed through the cellulosic fibrous web and through the TAD fabric to continue the dewatering process. The air molds the towels or tissues to the topography of the TAD fabric, giving the web a three-dimensional structure.

In other applications, the fabric may be used in the production of wetlaid, drylaid, melt blown and spunbonded nonwoven textiles.

Depending upon the product being produced, it may be desirable to have a pattern thereon. Passing the product through a two roll nip having at least one roll having a pattern thereon which is imprinting onto the product or paper is well known. Examples of this method is shown in U.S. Pat. Nos. 4,526,652; 5,126,015; and 5,766,416

This may also, however, be accomplished through the use of embossed fabrics which serve to imprint the embossment onto the product being produced. For example, an early TAD fabric as described in U.S. Pat. No. 3,301,746 created a multi-region structure in the web by imprinting the knuckle pattern of its weave thereon.

An improvement on this was the inclusion of a resinous frame work on the woven substrate of the fabric. Examples of this type fabric are shown in U.S. Pat. Nos. 4,514,345; 4,528,239; 4,529,480; 4,637,859; and 5,066,532.

Another method of providing an embossment on a fabric is shown in WO 98/27277 which discloses a papermaker's fabric comprising a batt of fibers with the fabric having an embossed surface. The batt of fibers are heated with a pattern imprinted thereon while in a molten state. An improvement on this can be found in WO 99/09247.

Alternatively, the fabric may be a laminated structure with the top layer being embossed as disclosed in U.S. Pat. No. 4,541,895.

SUMMARY OF THE INVENTION

The present invention is an industrial process fabric designed for use as a forming, pressing, drying, TAD, pulp forming, or an engineered fabric used in the production of nonwoven textiles, which is in the form of an endless loop and functions in the manner of a conveyor. The fabric of the invention may also be used in sludge dewatering or in a Double Nip Thickener ("DNT"), which dewaters de-inked paper pulp. The fabric may be itself embossed with pre-selected topographic features in a pattern suited for the end product and its intended use.

In one aspect of the invention, the industrial process fabric has an embossed backside and is used in combination with a vented or non-vented shoe press belt. When the belt has a smooth or blind drilled surface, the press fabric embossments on the backside is advantageous to increase water removal. The pattern of the embossments on the backside may vary as will be discussed.

In another aspect of the invention, two initially distinct, independent fabrics are joined together by known processes, such as needling. Each of the fabrics has an embossed pattern on one of its surfaces. The fabrics are laminated together such that the embossed patterns are in contact with each other, creating a pattern of voids within the laminated fabric, which the skilled artisan can arrange as necessary to manipulate the properties of the fabric. For example, the patterns of the fabrics could be matching and complementary, with the embossed pattern of one fabric lining up with the embossed pattern of the second fabric. The voids or valleys of each fabric would therefore be in alignment with each other. The internal voids thus formed within the fabric laminate would create water receptacles within the fabric. This matching, complementary alignment is just one of an infinite number of possibilities.

In another embodiment, the patterns of two fabrics may be matching and offset from each other, at a desired angle. For example, a 90° orientation would promote steady state pressing properties. The two opposing embossed patterns would create a "bridge" effect inside the fabric, preventing the two fabrics that form the laminate from nesting into each other. This results in better caliper retention, improved water handling, longer fabric life, and an easier-to-clean fabric.

In another embodiment, the patterns need not be matching, and could be aligned in a pre-selected pattern or randomly. An infinite number of arrangements are possible, since embossing technology permits the formation of virtually any possible pattern, which can then be joined with any other possible pattern.

Embossed fabrics may be prepared through the use of a device having embossments thereon which are heated having two opposed elements between which the fabric may be compressed at pre-selected levels of compression for pre-selected time intervals. Alternatively, the fabric can be pre-heated before being embossed. For example, embossment may be provided by a two-roll calendar, one or both rolls of which may be engraved or etched, which allows for continuous embossing. In addition, the fabric may include a low melt fiber, a fusible adhesive web or spray adhesive which can be used to reinforce and maintain the embossed pattern in the fabric while the fabric is functioning in its intended use.

Alternatively, a platen press, with upper and lower platens might also be used if the application warrants it. An embossing medium is used which has a pre-selected embossing pattern, and is capable of being readily changed from one embossing pattern to another, for example, by changing the engraved calendar rolls. In addition, the embossing method provides versatility in making desired embossed fabrics for multiple applications. The properties of the desired embossed fabric depend upon the control of certain process variables under which embossing takes place and selection of the substrate. The process variables include time, temperature, pressure, gap setting and roll composition.

BRIEF DESCRIPTION OF THE DRAWINGS

Thus by the present invention its objects and advantages will be realized the description of which should be taken in conjunction with the drawings wherein.

DETAILED DESCRIPTION OF THE PREFERRED EMBODIMENT

Figure 1:
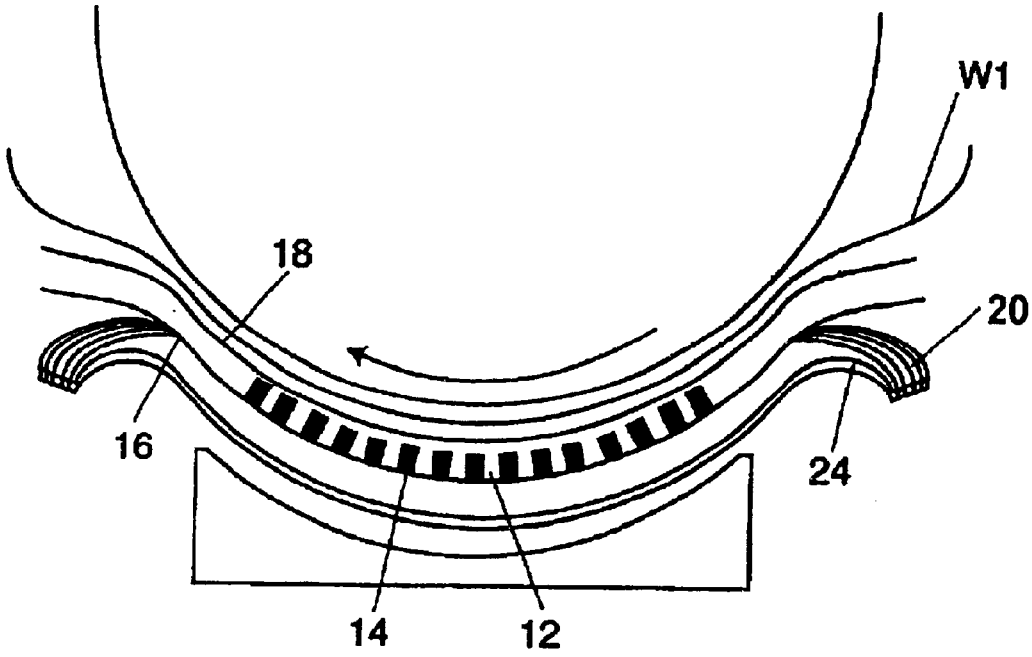
FIG. 1 is a perspective view of an embossed fabric in an long nip press incorporating the teachings of the present invention.

Turning now more particularly to the drawings, FIG. 1 shows a representative illustration of a long nip press including a cutaway portion of the paper sheet or web W, grooved shoe belt 24 and embossed fabric 10.

It should be understood that, while a LNP is illustrated, the present invention has applications beyond this. While it is particularly advantageous for use in an LNP, it also has applications in other situations where pressing is used as the extraction mechanism or situations where void volumes within the fabric are important or desired. Generally, fabric 10 may be woven preferably from yarns extruded from a polymeric resin material, such as polyamide and polyester resin materials. A variety of yarns including multifilaments and monofilaments may be used. A variety of weave patterns, none of which are critical for the practice of the present invention, may be used for this purpose, and, as is well known to those of ordinary skill in the art, the fabrics may be of either single or multiple layers, woven or nonwoven, and usually include batt fiber on one or both surfaces. Nonwoven fabrics may include extruded meshes, knitted fabrics, or the like. Batt fiber is applied to either or both the outer sheet contact surface and to the inner or backside contact surface of the press fabric by needling or hydroentangling.

In fabric 10, deformed elements 14 are embossed upon the fabric 10 with raised or land areas 12 separating the embossed deformation. This may be the result of an in-plane deformation of the fabric 10. In this regard, the fabric 10 is deformed or compressed in area 14. One side 16 of the fabric 10 includes the embossment whereas the opposite side 18 remains flat. Embossment may be in-plane, as shown, or out-of-plane where the material of the fabric 10 is displaced resulting in a raised portion on one side and a corresponding depression on the other side. As shown, the embossments of the fabric are perpendicular to the MD grooves 20 that are present on the grooved shoe belt 24. The grooves 20 of the grooved shoe belt 24 provide temporary storage sites for water removal from the paper sheet or web W.

The embossed pattern on the backside of the press fabric 10 provides additional sites for the temporary storage of water, further enhancing the water removal process. The backside pattern can be MD oriented channels (embossments) that would function to vent the press nip and enhance dewatering when the shoe belt has a plain or smooth non-vented surface. The pattern can be of different varieties as, for example, channels may be provided in the MD direction or channels at oblique angles to the MD direction, CD direction or both and at the same depth or different depths. Rather than channels, embossments of different shapes, such as circular openings, may be utilized which is something that would be readily apparent to the skilled artisan.

Figure 2:
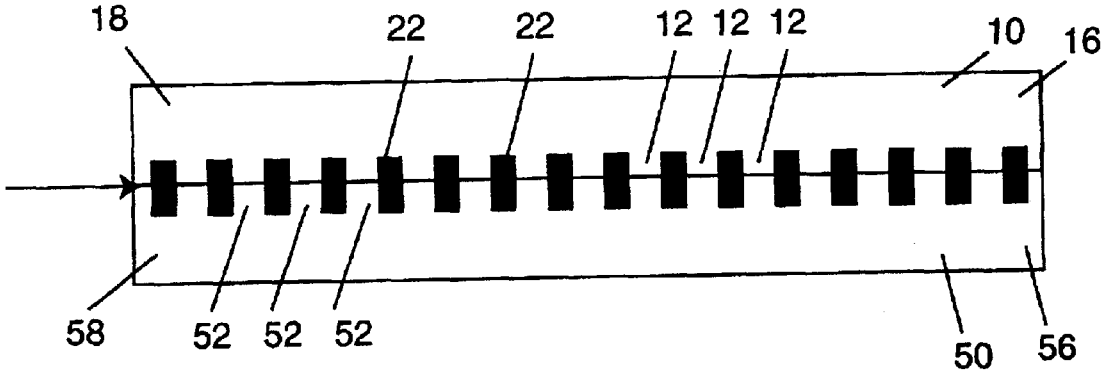
FIG. 2 is a perspective view of an embodiment of the present invention wherein two fabrics are affixed together with their respective embossed patterns facing each other.

Turning now to FIG. 2, an arrangement is shown wherein fabrics 10 and 50 are joined together by needling or other known techniques for joining fabrics together such as gluing or heat fusing or other means suitable for the purpose. Each fabric 10 and 50 has raised land areas 12 and 52 separating compressed embossments at their respective adjoining surfaces. The opposite or outer surfaces 18 and 58, are flat. The land areas 12 and 52 are in contact with each other, creating a pattern of voids 22 within the fabrics, which the skilled artisan could control in order to manipulate the properties of the fabric. In the embodiment shown in FIG. 2, the raised land areas and voids therein form a matching pattern on their respective fabrics 10 and 50. That is, the embossed patterns are matching and complementary, with the raised land areas 12 and 52 of one fabric lining up with the raised land areas of the second fabric. This also means that the voids 22 of each fabric are in alignment with each other, creating water receptacles within the fabric. This matching, complementary alignment is just one of an essentially infinite number of possibilities of patterns.

Figure 3:
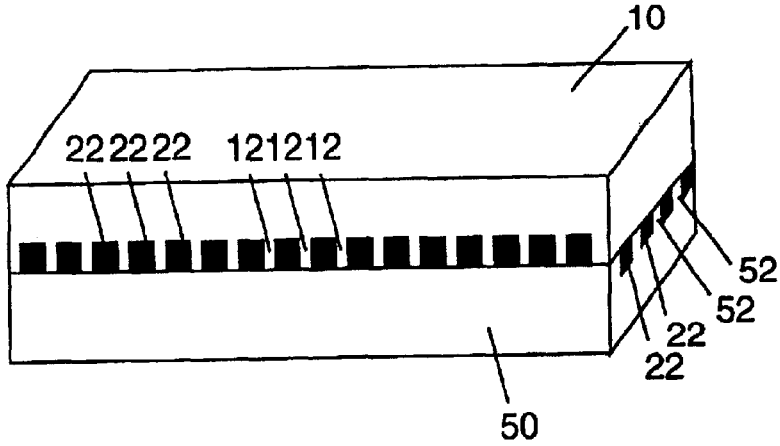
FIG. 3 is a perspective view of another embodiment of the present invention wherein two fabrics are affixed together with their respective embossed patterns facing each other at an angle of 90°.

In another embodiment (FIG. 3), the raised land areas 12 and 52 of two fabrics 10 and 50 could be identical yet offset from each other, such as at an angle of 90°, or any other angle. The two opposing embossed patterns would create a bridge effect inside the fabric. This would prevent the two fabrics from nesting into each other. This should result in better caliper retention, improved water handling, longer fabric life, and an easier-to-clean fabric.

It should be understood that the patterns need not be matching, and could be aligned in a pre-selected pattern or randomly. It may be that an infinite number of arrangements are possible, since embossing technology permits the formation of virtually any possible pattern, which can then be joined with any other possible pattern (for example, a pattern of holes aligned with grooves in the fabric or in a grooved shoe belt, holes non-aligned with grooves, holes partially aligned with grooves or any combination thereof).

Alternative embodiments are also envisioned. For example, an industrial process fabric may be composed of two fabrics laminated together with the embossments occurring on surfaces that are consequently brought together to form internal voids in the fabric.

Figure 4:
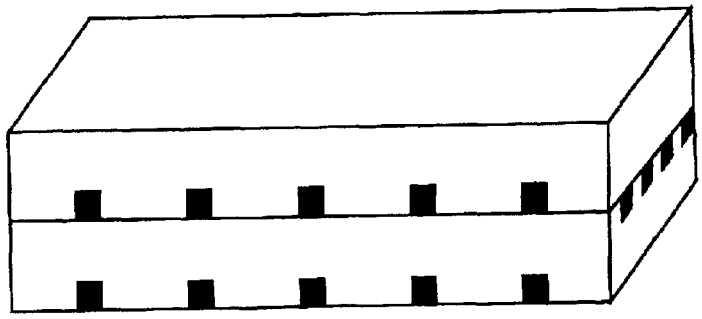
FIG. 4 is a perspective view of another embodiment of the present invention wherein two fabrics are affixed together with respective embossed patterns facing each other in addition to further embossments on the bottom surface of the second fabric.

In addition, the outer surfaces of the fabric that make up the bottom fabric can have a pattern (see FIG. 4). This pattern can be the result of out of plane embossing or both sides can be embossed with different patterns. So when this fabric is formed, there are both internal voids and backside voids.

Another embodiment may also be a laminate whereby one surface of each fabric is embossed. In this case the fabrics have one planar and one embossed surface. The top fabric is laminated so that its planar surface is on the outside or paper contacting side. The bottom fabric is oriented such that its planar surface is in contact with the embossed surface of the top fabric, and the second fabric's embossment is now on the bottom side of the laminated fabric. In these embodiments batt fiber may also be included on one or both surfaces. For example, with a press fabric, the surfaces all contain batt fiber, even the surfaces of both fabrics that make up the laminate. For other industrial process fabrics, the fabric may not have any batt component.

In all the embodiments, it should be understood that the embossments affect some characteristic of the fabric itself, such as fluid handling, void volume, and compaction resistance, among others. Moreover, the purpose of the embossments is not, however, to impart a pattern to the paper, tissue, or nonwoven product to which it comes into contact.

Figure 5:
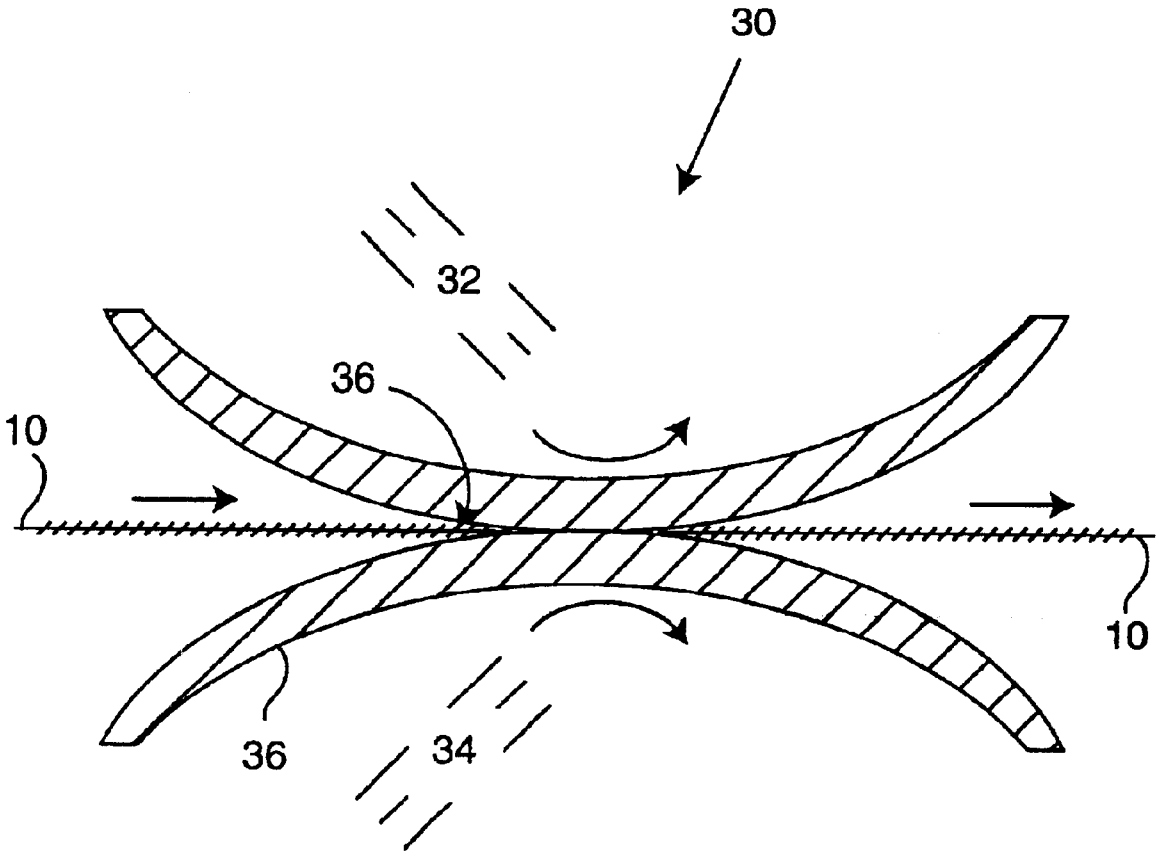
FIG. 5 is a schematic cross sectional view of the embossing device which comprises a two roll calendar.

A method for embossing the fabric with the desired pattern is also disclosed. As shown in FIG. 5, a two-roll calender 30 is formed by a first roll 32 and a second roll 34. The calender rolls, one or both, may be engraved or etched to provide for the embossing. The fabric 10 is fed into the nip 36 formed between the first and second rolls 32, 34, which are rotating in the directions indicated by the arrows. Either or both the rolls 32, 34 of the calender 30 are heated to the appropriate temperature. The rotational speed of the rolls 32, 34 is governed by the retention time needed for the fabric 10 to be embossed in the nip 36, the necessary force being provided by pressing the first and second rolls 32, 34 together to form a nip of the required thickness.

The extent to which the fabric is embossed can be varied. It can be the full width of the fabric or any portion or segment thereof. A heating or pre-heating of the fabric being embossed may be desirable and accordingly, a heating device may be utilized. This may be done, for example, by way of a hot-air oven, a heated roll which may be one or both rolls of the calender as aforementioned, infrared heaters or any other means suitable for this purpose.

Turning now to the fabric on which the embossment is to occur, such a fabric may be any fabric consistent with those typically used in current papermaking or nonwoven textile processes. The fabric is preferably of the type that has a woven substrate and may be a forming, press, dryer, TAD, pulp forming, or an engineered fabric, depending upon the particular application in which the fabric is to be utilized. Other substrates can be used, including a substrate formed by using strips of material spiraled together as taught by U.S. Pat. Nos. 5,360,656 and 5,268,076, the teachings of which are incorporated herein by reference. Also when used as a press fabric, staple fiber may be applied to the substrate on one or both sides of the substrate by a process of needling. Other substrates well known to those of ordinary skill in the art can also be used. The variables that ultimately control the formation of the fabric embossment include the temperature of the rolls and the fabric, the pressure between the rolls, the speed of the rolls, the embossing or roll pattern, and the gap between the rolls. All variables need not be addressed in every situation. For example, when employing a gap setting between the rolls, the resulting pressure between the rolls is a manifestation of the resistance to deformation of the fabric. The mechanical loading system of the calender maintains the gap between the rolls. The rolls may have different temperature settings, and pre-heating of the fabric may or may not be used depending upon the circumstances involved.

The method described results in an altered topography and permeability of the resulting fabric. A pattern similar to the pattern of the embossing roll will be transferred to the fabric. This pattern may stem from in-plane deformation, where the nominal caliper of the fabric remains constant and areas comprising the pattern are compressed. In that situation the fabric has a patterned side and a smooth side. The pattern could also result from out-of-plane deformation where the nominal fabric caliper has increased due to physical movement of material out of the original plane of the fabric. In that situation the pattern exists on both sides, with one side consisting of a protuberance with a corresponding cavity on the opposite side. In this situation compression may or may not occur. Changes in permeability to fluid (air and water) of the fabric can be affected by carefully controlling the amount of compression in the patterned areas. Compression to varying degrees without fusion of the fabric of the laminate material could result in a situation where the permeability of the fabric in the embossed areas is less than the original permeability, but not reduced to zero.

High temperatures and pressures could ultimately result in fusion of the fibers in the embossed areas, completely sealing the areas. This would result in a "perm-no perm" situation. As the application warrants, the permeability in these areas could be altered over a range of desired values.

For example, if it was desirable to maintain a degree of permeability in the areas of the pattern, it could be accomplished by the inclusion of a bicomponent or low melt fiber into the fabric being embossed. This will allow for the pattern to be embossed on the heat-contacting surface which retains the pattern while not requiring excessive heat that results in undesired melting of the surface that reduces or eliminates its water transport capabilities.

Other methods of forming a porous, bonded pattern include the use of an open, flexible adhesive web incorporated into the fabric or a spray adhesive component that would melt under heat and pressure. Accordingly, depending upon the desired results, such alternate methods of embossing are envisioned.

Lamination of fabric layers may be by needling, gluing, heat fusing or for any other means suitable for purpose and the laminate may comprise woven, nonwoven, knitted, extruded mesh substrates or any combination thereof. Also, in the laminate case, the bottom fabric can be embossed on both surfaces.

Thus it can be seen that through the selection of the process desired (and, of course, the elements to implement the process), controlling of the variables involved, and selecting the type of fabric to be embossed, the afore-described method provides for versatility in creating the desired embossed industrial process fabric.

Thus by the present invention its advantages are realized and although preferred embodiments have been disclosed and described in detail herein, its scope should not be limited thereby, rather its scope should be determined by that of the appended claims.

What is claimed is:

1. An industrial process fabric in the form of an endless loop which functions in the manner of a conveyor in making product from which fluid is being extracted whilst being carried on the fabric comprising:

a substrate having a top surface and bottom surface and a nominal thickness along a plane, said product being carried on the top surface; and a pattern embossed upon the bottom surface of the substrate, and said pattern creating a void for receiving fluid which passes through the substrate.

2. The fabric as claimed in claim 1 wherein the substrate is a woven substrate.

3. The fabric as claimed in claim 2 wherein the fabric is woven from monofilament or multifilament yarns.

4. The fabric as claimed in claim 1 wherein the substrate is a polymeric substrate.

5. The fabric as claimed in claim 1 wherein the fabric comprises low melt fiber which is treated to reinforce and maintain the pattern.

6. The fabric as claimed in claim 1 which comprises a fusible web component of the fabric which is treated to reinforce and maintain the pattern.

7. The fabric as claimed in claim 2 which comprises a fusible web component of the fabric which is treated to reinforce and maintain the pattern.

8. The fabric as claimed in claim 2 which comprises a spray adhesive component of the fabric which is treated to reinforce and maintain the pattern.

9. The fabric as claimed in claim 1 which includes providing an industrial process fabric which is selected from the following group: forming fabric, press fabric, drying fabric, TAD fabric, pulp forming fabric, engineered fabric, sludge dewatering fabric or DNT fabric.

10. The fabric as claimed in claim 1 wherein the fabric includes a fiber batt layer as its top surface, bottom surface or both.

11. The fabric as claimed in claim 1 wherein the top surface is substantially smooth.

12. An industrial process fabric in the form of an endless loop which functions in the manner of a conveyor in making product from which fluid is being extracted whilst being carried on the fabric, comprising:

a substrate having a top surface and bottom surface and a nominal thickness along a plane, said product being carried on the top surface; and a pattern embossed upon the bottom surface of the substrate, and said pattern creating a void for receiving fluid which passes through the substrate, wherein the substrate is a polymeric substrate and the fabric comprises low melt fiber which is treated to reinforce and maintain the pattern.

13. An industrial process fabric in the form of an endless loop which functions in the manner of a conveyor in making product from which fluid is being extracted whilst being carried on the fabric, comprising:

a substrate having a top surface and bottom surface and a nominal thickness along a plane, said product being carried on the top surface;

a pattern embossed upon the bottom surface of the substrate, and said pattern creating a void for receiving fluid which passes through the substrate; and a spray adhesive component of the fabric which is treated to reinforce and maintain the pattern.

14. An industrial process fabric in the form of an endless loop which functions in the manner of a conveyor in making product from which fluid is being extracted whilst being carried on the fabric, comprising:

a first substrate having a top surface and a bottom surface and a nominal thickness along a plane, said product being carried on the top surface;

a first pattern embossed upon the bottom surface of the first substrate, said first pattern creating voids for receiving fluid which passes through the fabric;

a second substrate having a top surface and a bottom surface and a nominal thickness along a plane;

a second pattern embossed upon the second substrate, said second pattern creating voids for receiving fluid which passes through the fabric: and wherein said bottom surface of the first substrate and the top surface of the second substrate being in an adjoining relationship and said first and second substrates being joined together.

15. The fabric as claimed in claim 14 wherein the second pattern is embossed upon the top surface of the second substrate and said first pattern and said second pattern are positioned in an adjacent relationship.

16. The fabric as claimed in claim 14 wherein the first and second substrate are joined together by needling, gluing or heat fusing.

17. The fabric as claimed in claim 14 wherein the first and second pattern are identical to each other and are in a matching relationship with each other.

18. The fabric as claimed in claim 14 wherein the first and second pattern are identical to each other and are offset from each other.

19. The fabric as claimed in claim 14 wherein the first and second pattern differ from each other.

20. The fabric as claimed in claim 14 which includes providing a fabric having a woven substrate.

21. The fabric as claimed in claim 14 which includes providing a fabric having a polymeric substrate.

22. The fabric as claimed in claim 14 which comprises a fusible web component of the fabric which is treated to reinforce and maintain at least one of said patterns.

23. The fabric as claimed in claim 14 which includes a fabric which is nonwoven.

24. The fabric as claimed in claim 14 which includes providing an industrial process fabric which is selected from the following group: forming fabric, press fabric, drying fabric, TAD fabric, pulp forming fabric, engineered fabric, sludge dewatering fabric or DNT fabric.

25. The fabric as claimed in claim 20 wherein said fabric is woven from monofilament or multifilament yarns.

26. The fabric as claimed in claim 14 which includes a fiber batt layer as its top surface, bottom surface or both.

27. The fabric as claimed in claim 14 wherein the top surface of the first substrate is substantially smooth.

28. The fabric as claimed in claim 20 which comprises a fusible web component of the fabric which is treated to reinforce and maintain at least one of the patterns.

29. An industrial process fabric in the form of an endless loop which functions in the manner of a conveyor in making product from which fluid is being extracted whilst being carried on the fabric, comprising:

a first substrate having a top surface and a bottom surface and a nominal thickness along a plane, said product being carried on the top surface;

a first pattern embossed upon the bottom surface of the first substrate, said first pattern creating voids for receiving fluid which passes through the fabric;

a second substrate having a top surface and a bottom surface and a nominal thickness along a plane; and a second pattern embossed upon the second substrate, said second pattern creating voids for receiving fluid which passes through the fabric, wherein said bottom surface of the first substrate and the top surface of the second substrate being in an adjoining relationship and said first and second substrates being joined together; and a third pattern embossed upon the bottom surface of the second substrate.

30. The fabric as claimed in claim 29 wherein the fabric comprises low melt fiber which is treated to reinforce and maintain at least one of said patterns.

31. The fabric as claimed in claim 29 which comprises a fusible web component of the fabric which is treated to reinforce and maintain at least one of said patterns.

32. The fabric as claimed in claim 29 which comprises a spray adhesive component of the fabric which is treated to reinforce and maintain at least one of said patterns.

33. An industrial process fabric in the form of an endless loop which functions in the manner of a conveyor in making product from which fluid is being extracted whilst being carried on the fabric, comprising:

a first substrate having a top surface and a bottom surface and a nominal thickness along a plane, said product being carried on the top surface;

a first pattern embossed upon the bottom surface of the first substrate, said first pattern creating voids for receiving fluid which passes through the fabric;

a second substrate having a top surface and a bottom surface and a nominal thickness along a plane; and a second pattern embossed upon the second substrate, said second pattern creating voids for receiving fluid which passes through the fabric, wherein said bottom surface of the first substrate and the top surface of the second substrate being in an adjoining relationship and said first and second substrates being joined together, and wherein the second pattern is embossed on the bottom surface of the second substrate.

34. An industrial process fabric in the form of an endless loop which functions in the manner of a conveyor in making product from which fluid is being extracted whilst being carried on the fabric, comprising:

a first substrate having a top surface and a bottom surface and a nominal thickness along a plane, said product being carried on the top surface;

a first pattern embossed upon the bottom surface of the first substrate, said first pattern creating voids for receiving fluid which passes through the fabric;

a second substrate having a top surface and a bottom surface and a nominal thickness along a plane; and a second pattern embossed upon the second substrate, said second pattern creating voids for receiving fluid which passes through the fabric; and wherein said bottom surface of the first substrate and the top surface of the second substrate being in an adjoining relationship and said first and second substrates being joined together, wherein the fabric comprises low melt fiber which is treated to reinforce and maintain at least one of said patterns.

35. An industrial process fabric in the form of an endless loop which functions in the manner of a conveyor in making product from which fluid is being extracted whilst being carried on the fabric, comprising:

a first substrate having a top surface and a bottom surface and a nominal thickness along a plane, said product being carried on the top surface;

a first pattern embossed upon the bottom surface of the first substrate, said first pattern creating voids for receiving fluid which passes through the fabric;

a second substrate having a top surface and a bottom surface and a nominal thickness along a plane;

a second pattern embossed upon the second substrate, said second pattern creating voids for receiving fluid which passes through the fabric: and wherein said bottom surface of the first substrate and the top surface of the second substrate being in an adjoining relationship and said first and second substrates being joined together; and a spray adhesive component of the fabric which is treated to reinforce and maintain at least one of said patterns.

36. An industrial process fabric in the form of an endless loop which functions in the manner of a conveyor in making product from which fluid is being extracted whilst being carried on the fabric, comprising:

a first substrate having a top surface and a bottom surface and a nominal thickness along a plane, said product being carried on the top surface;

a first pattern embossed upon the bottom surface of the first substrate, said first pattern creating voids for receiving fluid which passes through the fabric;

a second substrate having a top surface and a bottom surface and a nominal thickness along a plane; and a second pattern embossed upon the second substrate, said second pattern creating voids for receiving fluid which passes through the fabric, wherein said bottom surface of the first substrate and the top surface of the second substrate being in an adjoining relationship and said first and second substrates being polymeric and joined together, and wherein the fabric comprises low melt fiber which is treated to reinforce and maintain at least one of the patterns.

37. An industrial process fabric in the form of an endless loop which functions in the manner of a conveyor in making product from which fluid is being extracted whilst being carried on the fabric, comprising:

a first substrate having a top surface and a bottom surface and a nominal thickness along a plane, said product being carried on the top surface;

a first pattern embossed upon the bottom surface of the first substrate, said first pattern creating voids for receiving fluid which passes through the fabric;

a second substrate having a top surface and a bottom surface and a nominal thickness along a plane;

a second pattern embossed upon the second substrate, said second pattern creating voids for receiving fluid which passes through the fabric, wherein said bottom surface of the first substrate and the top surface of the second substrate being in an adjoining relationship and said first and second substrates being woven and joined together; and a spray adhesive component of the fabric which is treated to reinforce and maintain at least one of the patterns.

* * * * *